US006555306B1

(12) United States Patent
Vargas et al.

(10) Patent No.: US 6,555,306 B1
(45) **Date of Patent: *Apr. 29, 2003**

(54) PHOTOGRAPHIC ELEMENT WITH DYE-FORMING COUPLER AND IMAGE DYE STABILIZING COMPOUND

(75) Inventors: J. Ramon Vargas, Webster, NY (US); Gary M. Russo, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/027,410

(22) Filed: Dec. 21, 2001

(51) Int. Cl.[7] ..... G03C 1/08; G03C 7/26; G03C 7/32

(52) U.S. Cl. ..... 430/551; 430/543; 430/546; 430/556; 430/557

(58) Field of Search ..... 430/543, 551, 430/556, 557, 546

(56) References Cited

U.S. PATENT DOCUMENTS

| | | | |
|---|---|---|---|
| 4,749,645 | A | 6/1988 | Goddard et al. |
| 4,782,011 | A | 11/1988 | Goddard et al. |
| 5,091,294 | A | 2/1992 | Nishijima et al. |
| 5,188,926 | A | 2/1993 | Schofield et al. |
| 5,192,646 | A | 3/1993 | Merkel et al. |
| 5,284,742 | A | 2/1994 | Yamazaki et al. |
| 5,294,530 | A | 3/1994 | Seto et al. |
| 5,352,572 | A | 10/1994 | Seto et al. |
| 5,426,021 | A | 6/1995 | Krishnamurthy et al. |
| 5,441,855 | A | 8/1995 | Weber et al. |
| 5,441,861 | A | 8/1995 | Weber et al. |
| 5,466,569 | A | 11/1995 | Weber et al. |
| 5,567,578 | A | 10/1996 | Makuta et al. |
| 5,891,613 | A | 4/1999 | Zengerle et al. |
| 5,935,773 | A | 8/1999 | Hagemann et al. |

FOREIGN PATENT DOCUMENTS

| | | |
|---|---|---|
| DE | 4307439 | 9/1994 |
| DE | 4320828 | 1/1995 |
| DE | 19632927 | 2/1998 |
| EP | 310 551 | 4/1989 |
| EP | 310 552 | 4/1989 |
| EP | 538 862 | 4/1993 |
| EP | 1 116 997 | 7/2001 |
| GB | 1267287 | 3/1972 |
| WO | 91/08515 | 6/1991 |

*Primary Examiner*—Geraldine Letscher
(74) *Attorney, Agent, or Firm*—Andrew J. Anderson

(57) ABSTRACT

Photographic elements are disclosed comprising a silver halide emulsion layer having associated therewith a dye forming coupler and a compound of the following Formula I:

I wherein n=0–6 and each R is independently hydrogen, an aromatic, cyclic, linear or branched chain hydrocarbon group, NR'R", or OR'; where R' is an aromatic, cyclic, linear or branched chain hydrocarbon group and R" is hydrogen or an aromatic, cyclic, linear or branched chain hydrocarbon group. Photographic elements of the present invention upon exposure and photographic processing exhibit good activity and yield dye images that have unexpected and substantial improvements in the stability of the formed image dyes.

21 Claims, No Drawings

PHOTOGRAPHIC ELEMENT WITH DYE-FORMING COUPLER AND IMAGE DYE STABILIZING COMPOUND

FIELD OF INVENTION

This invention relates to silver halide color photographic materials. More particularly, it relates to color photographic materials which contain dye-forming couplers in combination with non-imaging compounds which give rise to photographic images which have high stability towards fading by light.

BACKGROUND OF THE INVENTION

In a silver halide photographic element, a color image is formed when the element is exposed to light and then subjected to color development with a primary aromatic amine developer. Color development results in imagewise reduction of silver halide and production of oxidized developer. Oxidized developer reacts with one or more incorporated dye-forming couplers to form an imagewise distribution of dye.

In any polychromatic chromogenic photographic material it is desirable that the dyes so formed should have certain properties. For instance, the dyes should be bright in color with very little secondary absorption so that good color reproducibility is obtained. The stability of image dyes generated on chromogenic development often does not meet performance expectations. These expectations include resistance to light fade and both humid and dry heat dark fade. The dyes that are formed by any color coupler during processing have a tendency to fade over times as a result of exposure to light, heat, humidity and oxygen resulting in a deterioration of the original recorded image. It is therefore highly desirable that the formed dyes should be resistant towards fading by heat, humidity and light.

Techniques are known in the art for providing resistance to light fade of photographic dyes. Compounds which have been disclosed as light stabilizers for yellow image dyes, e.g., include substituted phenolic and blocked phenolic compounds including; heterocyclic phosphorous materials (U.S. Pat. No. 4,749,645), phenolic thiane derivatives (EP 0 310 551), substituted and blocked bisphenols (UK 1,267, 287, U.S. Pat. No. 4,782,011, DE 4,307,439, DE 4,307,439, DE 4,320,828, EP 0 508 398, EP 0 538 862, U.S. Pat. No. 5,294,530, U.S. Pat. No. 5,426,021, U.S. Pat. No. 5,441,855, U.S. Pat. No. 5,441,861, U.S. Pat. No. 5,466,569, U.S. Pat. No. 5,891,613, WO 91/008,515, U.S. Pat. No. 5,567,578, U.S. Pat. Nos. 5,284,742, 5,091,294, EP 0 310 552, U.S. Pat. No. 5,935,773). In addition, yellow dyes may also be stabilized against fading by light with the use of thiomorpholine dioxide compounds as described in EP 1 116 99. However, it is desirable to improve on the light stabilization of yellow dyes beyond that afforded with use of the above stabilizers.

German patent application DE 1 96 32927 describes the use of cyclic imides, cyclic carbamates, and cyclic ureas as a means of improving the chromogenically developed color image dye stabilities. However, in particular, the amount of dye stabilization to light fade is only modest. U.S. Pat. No. 5,352,572 reports the use of a specific bis-urea compound in combination with malonamide yellow couplers. However, the bis-urea was not shown to be effective for other couplers and was specifically reported to be ineffective for beta-ketoamide yellow couplers.

SUMMARY OF THE INVENTION

An objective of this invention is to provide photographic elements which exhibit exceptional image dye stability. The present invention solves the problem of improving the chromogenically developed color image dye stabilities by employing a substituted dipiperidine additive. In accordance with the invention, a photographic element is disclosed comprising a silver halide emulsion layer having associated therewith a dye forming coupler and a compound of the following Formula I:

I

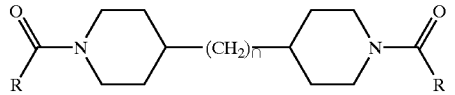

wherein n=0–6 and each R is independently hydrogen, an aromatic, cyclic, linear or branched chain hydrocarbon group, NR'R", or OR', where R' is an aromatic, cyclic, linear or branched chain hydrocarbon group and R" is hydrogen or an aromatic, cyclic, linear or branched chain hydrocarbon group.

We have found that the objective of the invention of providing photographic elements which exhibit exceptional image dye stability for dyes formed from couplers can be achieved with through the use of dipiperidinediamide, dipiperidinedicarbamate or dipiperidinediurea compounds of Formula I as stabilizing addenda. In accordance with preferred embodiments of the invention, such compounds may be used in combination with yellow dye-forming couplers, particularly in combination with substituted phenolic and/or thiomorpholine dioxide stabilizers. In addition to stabilizing properties, compounds of Formula I have organic solvent properties, and accordingly may be advantageously used partly or totally in place of conventional high boiling permanent and/or auxiliary organic coupler solvents to disperse the dye-forming couplers. Photographic elements of the present invention upon exposure and photographic processing exhibit good activity and yield dye images that have unexpected and substantial improvements in the stability of the formed image dyes.

DETAILED DESCRIPTION OF THE INVENTION

The photographic elements of this invention can be chromogenic black and white elements (for example, using yellow, magenta and cyan dye forming couplers), single color elements or multicolor elements. In accordance with preferred embodiments of the invention, the photographic elements comprise at least one yellow dye image forming layer, at least one cyan dye image forming layer and at least one magenta dye image forming layer. More particularly, multicolor photographic elements in accordance with preferred embodiments of the invention preferably comprise a support bearing light sensitive image dye forming layers sensitized to the blue (approx. 380–500 nm), green (approx. 500–600 nm), and red (approx. 600–760 nm) regions of the electromagnetic spectrum. In accordance with a preferred embodiment of the invention, the element comprises cyan, magenta and yellow dye forming silver halide emulsion hydrophilic colloid layer units sensitized to the red, green and blue regions of the spectrum. Each unit can comprise a single emulsion layer or multiple emulsion layers sensitive to a given region of the spectrum. The layers of the element, including the layers of the image forming units, can be arranged in various orders as known in the art. It is within the scope of this invention, however, for the light sensitive material to alternatively or additionally be sensitive to one or more regions of the electromagnetic spectrum outside the visible, such as the infrared region of the spectrum. In most color photographic systems, non-diffusing color-forming couplers are incorporated in the light-sensitive photographic emulsion layers so that during development, they are available in the emulsion layer to react with the color developing agent that is oxidized by silver halide image development. When the dye image formed is to be used in situ, couplers are selected which form non-diffusing dyes. Color photographic systems can also be used to produce black-and-white images from non-diffusing couplers as described, e.g., by Edwards, et al., in International Publication No. WO 93/012465.

Throughout this application a reference to any type of chemical "group" includes both the unsubstituted and substituted forms of the group described. Generally, unless otherwise specifically stated, substituent groups usable on molecules herein include any groups, whether substituted or unsubstituted, which do not destroy properties necessary for the photographic utility. It will also be understood throughout this application that reference to a compound of a particular general formula includes those compounds of other more specific formula which specific formula falls within the general formula definition. Examples of substituents on any of the mentioned groups can include known substituents, such as: halogen, for example, chloro, fluoro, bromo, iodo; alkoxy, particularly those with 1 to 6 carbon atoms (for example, methoxy, ethoxy); substituted or unsubstituted alkyl, particularly lower alkyl (for example, methyl, trifluoromethyl); alkenyl or thioalkyl (for example, methylthio or ethylthio), particularly either of those with 1 to 6 carbon atoms, substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl), and others known in the art. Alkyl substituents may specifically include "lower alkyl", that is having from 1 to 6 carbon atoms, for example, methyl, ethyl, and the like. Further, with regard to any alkyl group, alkylene group or alkenyl group, it will be understood that these can be branched or unbranched and include ring structures.

Compounds of Formula I which are employed as dye image stabilizing compounds in photographic elements in combination with dye forming couplers in accordance with the present invention may be prepared according to synthetic methods known in the art. R, R' and R" may be linear, cyclic or branched chained hydrocarbon groups, which may be the same or different, preferably ranging from 1 to 22 carbon atoms, more preferably from 1 to 14 carbon atoms and most preferably from 1 to 10 carbon atoms. Where R is NR'R", R' and R" may optionally combine together to form a ring with the associated nitrogen atom (such as piperidine or morpholine). Representative examples include: methyl, ethyl, propyl, iso-propyl, butyl, iso-butyl, pentyl, hexyl, ethylhexyl, octyl, nonyl, iso-nonyl, decyl, iso-decyl, undecyl, dodecyl, tridecyl, tetradecyl, myristyl, pentadecyl, cetyl, stearyl, arachidyl, behenyl, undecylenyl, palmitoleyl, oleyl, linoleyl, linolenyl, arachidonyl, erucyl, benzyl, cyclohexyl, phenoxyethyl and phenyl. This list is non exhaustive and may also include numerous other linear, branched chain, cyclic, or aromatic hydrocarbon groups.

Specific examples of compounds of Formula I include, but are not limited to, the following:

| | Formula I | | | |
|---|---|---|---|---|
| Compound | n | R | R' | R" |
| Ia | 3 | NR'R" | Et | Et |
| Ib | 3 | NR'R" | i-Pr | i-Pr |
| Ic | 3 | NR'R" | Me | Me |
| Id | 3 | NR'R" | i-Bu | i-Bu |
| Ie | 3 | NR'R" | Bu | Me |
| If | 3 | NR'R" | —$(CH_2)_5$— | |
| Ig | 3 | NR'R" | $C_5H_{11}$ | $C_5H_{11}$ |
| Ih | 3 | NR'R" | —$CH_2CH(Me)OCH(Me)$ $CH_2$— | |
| Ii | 3 | cyclo-$C_6H_{11}$ | — | — |
| Ij | 3 | $C_6H_{13}$ | — | — |
| Ik | 3 | $C_8H_{17}$ | — | — |
| Il | 2 | NR'R" | i-Pr | i-Pr |
| Im | 2 | NR'R" | i-Bu | i-Bu |
| In | 2 | NR'R" | $C_5H_{11}$ | $C_5H_{11}$ |
| Io | 2 | cyclo-$C_6H_{11}$ | — | — |
| Ip | 0 | NR'R" | i-Bu | i-Bu |
| Iq | 0 | NR'R" | $C_5H_{11}$ | $C_5H_{11}$ |
| Ir | 0 | $C_8H_{17}$ | — | — |
| Is | 0 | $C_{11}H_{23}$ | — | — |
| It | 3 | OR' | Et | — |
| Iu | 3 | OR' | Pr | — |
| Iv | 3 | OR' | Bu | — |
| Iw | 3 | NR'R" | $C_8H_{17}$ | H |
| Ix | 3 | NR'R" | Et | $CH_2C(Me)=CH_2$ |
| Iy | 3 | NR'R" | s-Bu | s-Bu |
| Iz | 3 | $C_5H_{11}$ | — | — |
| Iaa | 3 | CH(Et)Bu | — | — |
| Iab | 3 | CH=CHPh | — | — |
| Iac | 3 | $CH_2CH_2Ph$ | — | — |
| Iad | 3 | NR'R" | Me | Ph |
| Iae | 3 | $CH(Bu)C_6H_{13}$ | — | — |
| Iaf | 3 | $CHPr_2$ | — | — |
| Iag | 3 | $CH(C_6H_{13})C_8H_{17}$ | — | — |
| Iah | 3 | $C_{11}H_{23}$ | — | — |
| Iai | 3 | OR' | $CH_2CH=CH_2$ | — |
| Iaj | 3 | p-tolyl | — | — |
| Iak | 3 | p-(t-Bu)Ph | — | — |
| Ial | 3 | p-(OMe)Ph | — | — |
| Iam | 3 | p-$(NO_2)$Ph | — | — |
| Ian | 3 | p-$(OC_{12}H_{25})$Ph | — | — |

Syntheses of these compounds may use standard procedures as exemplified for the following synthesis of compound Ia: To a solution of 105.2 g of 4,4'-trimethylenedipiperidine dissolved in 800 mL of ethyl acetate was added a solution of 124.7 g of diethylcarbamyl chloride in 100 mL of ethyl acetate over 50 min. The resulting mixture was heated at reflux for one hour, then held at ambient temperature overnight. The reaction mixture was filtered and the solids were washed with ethyl acetate then heptane. The combined filtrates were washed four times with 2 N HCl, once with water, and concentrated in vacuo to provide an oil. Gas chromatography analysis determined the sample to be >96% pure. Combustion analysis for $C_{23}H_{44}N_4O_2$ (calcd, found): C (67.61, 67.44); H (10.84, 10.81); N (13.71, 13.63).

In accordance with a preferred embodiment of the present invention, the compounds of Formula I are used in combination with yellow, magenta, or cyan dye-forming couplers, and in particular acetanilide-based yellow dye forming coupler compounds. Such couplers are known compounds and can be prepared by techniques known to those skilled in the art. Individual yellow couplers may be used singly or in combinations. Couplers that form yellow dyes upon reaction with oxidized color developing agent and which are useful in elements of the invention are described, e.g., in such representative patents and publications as: U.S. Pat. Nos. 2,875,057, 2,407,210; 3,265,506; 2,298,443; 3,048,194; 3,447,928 and "Farbkuppler—Eine Literature Ubersicht,"

published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

Typical preferred acetanilide-based yellow couplers are represented by the following formulas:

YELLOW-1

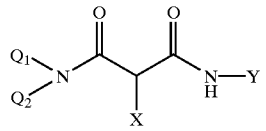

YELLOW-2

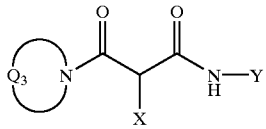

YELLOW-3

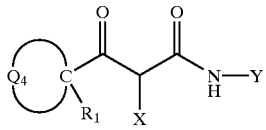

YELLOW-4

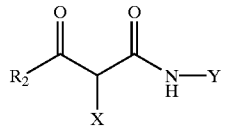

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and $Q_4$ represents nonmetallic atoms necessary to form a 3- to 5-membered hydrocarbon ring or a 3- to 5-membered heterocyclic ring which contains at least one hetero atom selected from N, O, S, and P in the ring. Preferred couplers are of YELLOW-1 and YELLOW-4 wherein $Q_1$ and $Q_2$ each represent an alkyl group, an aryl group, or a heterocyclic group, and $R_2$ represents an aryl or alkyl group, including cycloalkyl and bridged cycloalkyl groups, and more preferably a tertiary alkyl group. Particularly preferred yellow couplers for use in elements of the invention are represented by YELLOW-4, wherein $R_2$ represents a tertiary alkyl group and Y represents an aryl group, and X represents an aryloxy or N-heterocyclic coupling-off group. The elements of the invention are particularly useful in combination with yellow couplers of the above formulas wherein X represents a nitrogen-containing heterocyclic coupling-off group.

Image dye forming couplers that form magenta dyes upon reaction with oxidized color developing agents may be included in elements of the invention, such as are described in representative patents and publications such as: U.S. Pat. Nos. 2,600,788; 2,369,489; 2,343,703; 2,311,082; 2,908,573; 3,062,653; 3,152,896, 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034, 5,017,465; and 5,023,170. Examples of 1H-pyrazolo [1,5-b]-1,2,4-triazoles can be found in European Patent Applications 176,804; 177,765; U.S. Pats. Nos. 4,659,652; 5,066,575; and 5,250,400.

Typical pyrazoloazole and pyrazolone couplers are represented by the following formulas:

MAGENTA-1

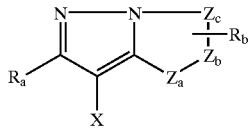

MAGENTA-2

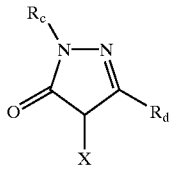

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group,=N—,=C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

Image dye forming couplers that form cyan dyes upon reaction with oxidized color developing agents may be included in elements of the invention, such as are described in representative patents and publications such as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948.

Typical cyan couplers are represented by the following formulas:

CYAN-1

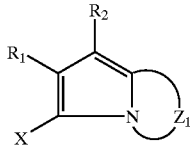

-continued

CYAN-2

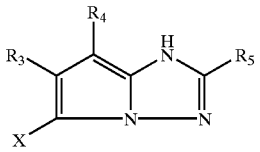

CYAN-3

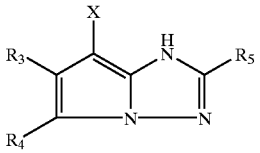

CYAN-4

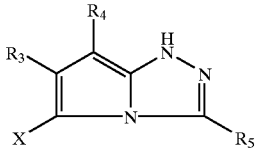

CYAN-5

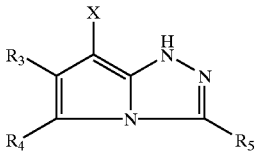

CYAN-6

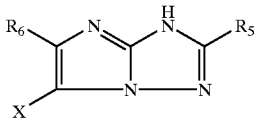

wherein $R_1$ and $R_5$ each represent a hydrogen or a substituent; $R_2$ represents a substituent; $R_3$ and $R_4$ each represent an electron attractive group having a Hammett's substituent constant $\sigma_{para}$ of 0.2 or more and the sum of the $\sigma_{para}$ values of $R_3$ and $R_4$ is 0.65 or more; $R_6$ represents an electron attractive group having a Hammett's substituent constant $\sigma_{para}$ of 0.35 or more, X represents a hydrogen of or a coupling-off group; $Z_1$ represents nonmetallic atoms necessary for forming a nitrogen-containing, six-membered, heterocyclic ring which has at least one dissociative group. A dissociative group has an acidic proton, e.g. —N—, —CH(R)—, etc., that preferably has a pKa value of from 3 to 12 in water. The values for Hammett's substituent constants can be found or measured as is described in the literature. For example, see C. Hansch and A. J. Leo, *J. Med. Chem.*, 16, 1207 (1973); *J. Med. Chem.*, 20, 304 (1977); and J. A. Dean, *Lange's Handbook of Chemistry*, 12th Ed. (1979) (McGraw-Hill).

More preferable are cyan couplers of the following formulas:

CYAN-7

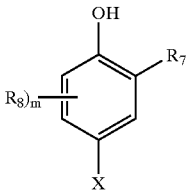

CYAN-8

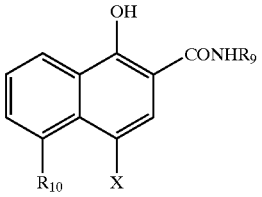

wherein $R_7$ represents a substituent (preferably a carbamoyl, ureido, or carbonamido group); $R_8$ represents a substituent (preferably individually selected from halogen, alkyl, and carbonamido groups); $R_9$ represents a ballast substituent; $R_{10}$ represents a hydrogen or a substituent (preferably a carbonamido or sulphonamido group); X represents a hydrogen or a coupling-off group; and m is from 1–3. Couplers of the structure CYAN-7 are most preferable for use in elements of the invention.

Representative couplers which may be used in the elements of the invention include the following yellow couplers YC1–YC21, magenta couplers MC1–MC17, and cyan couplers CC1–CC17:

YC1

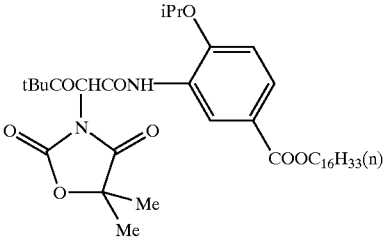

YC2

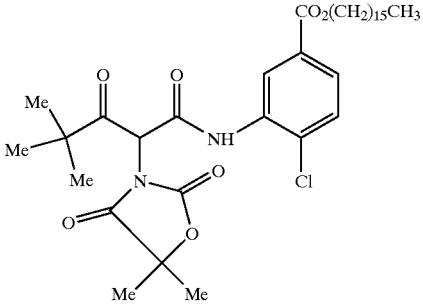

-continued
YC3
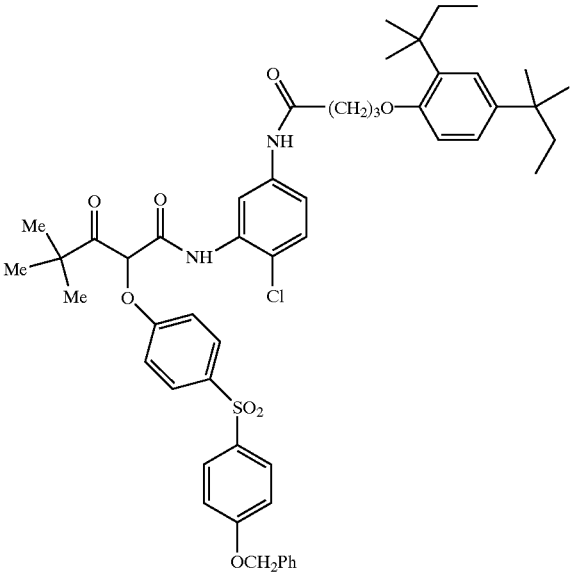
YC4
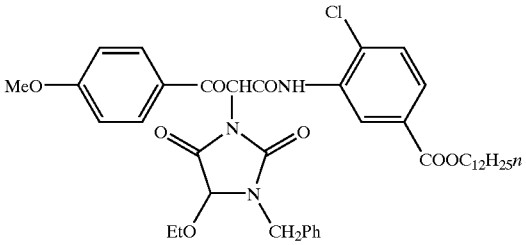
YC5
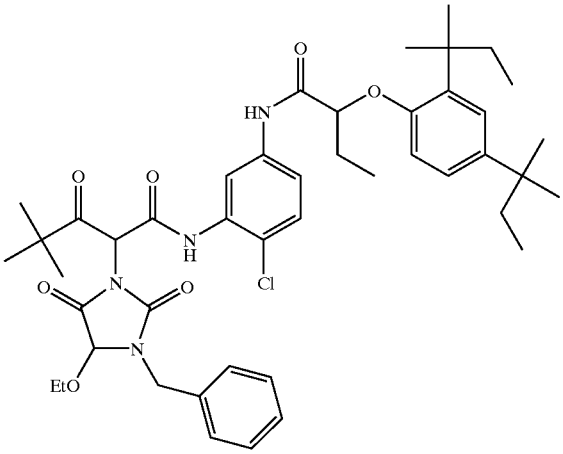
YC6
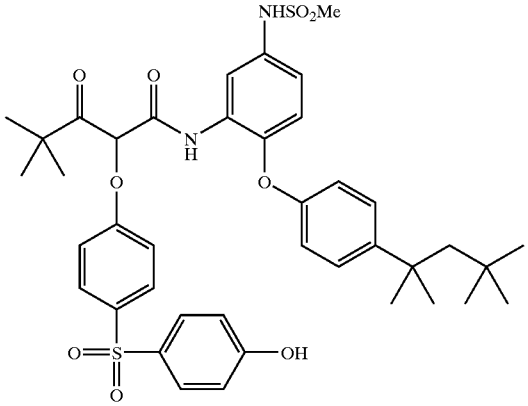
YC7
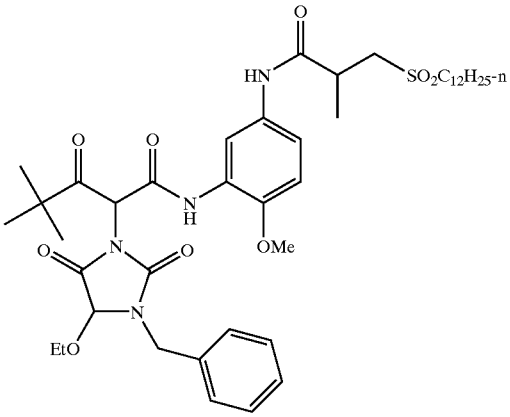
YC8
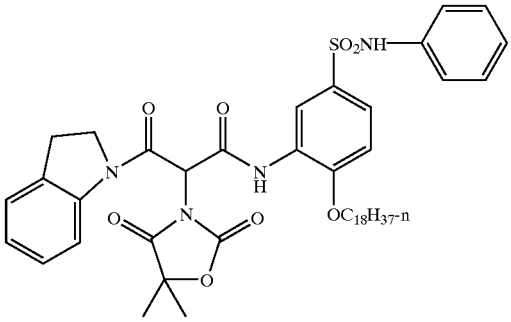

-continued
YC9
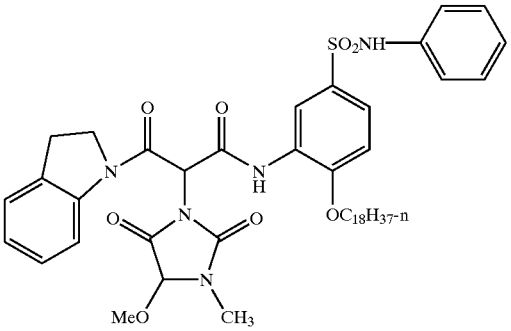
YC10
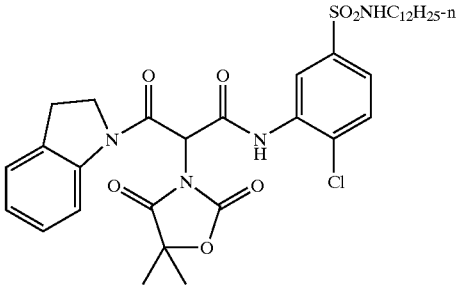
YC11
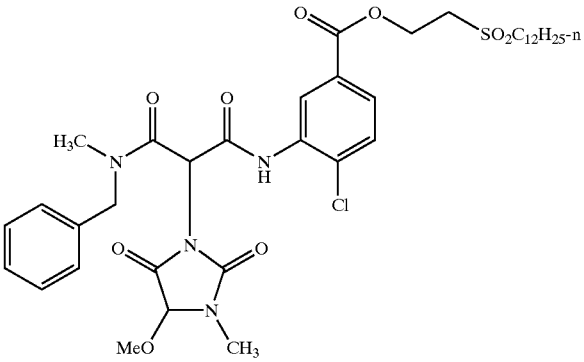
YC12
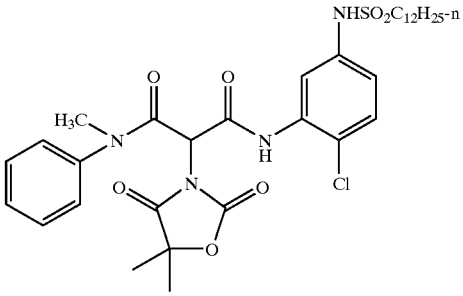
YC13
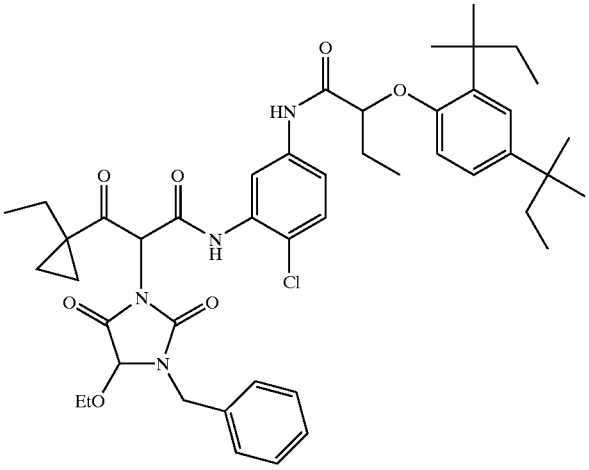
YC14
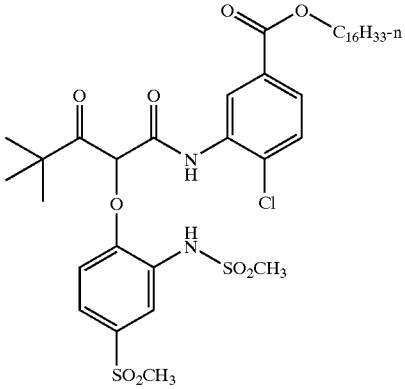
YC15
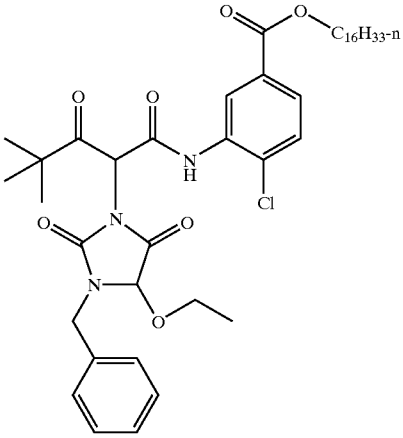
YC16
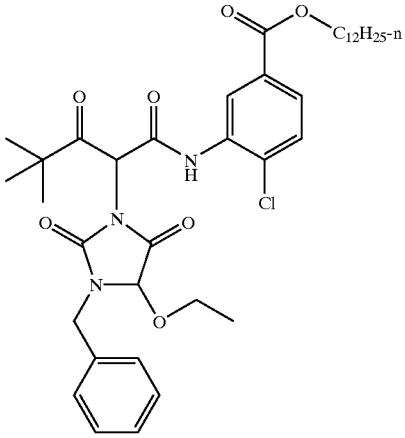

-continued
YC17
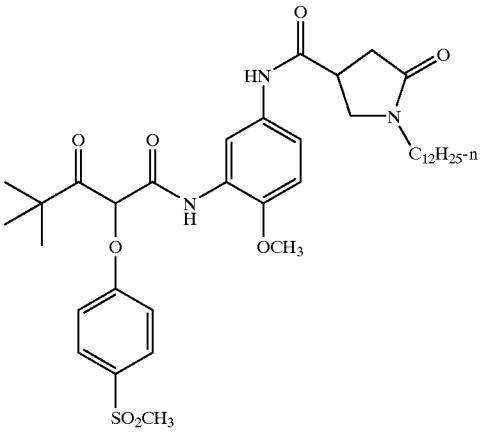
YC18
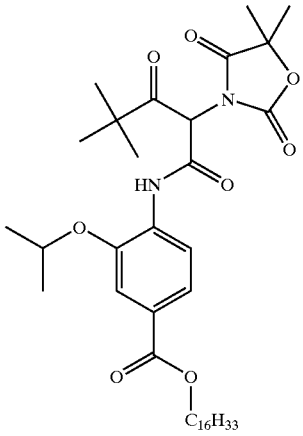
YC19
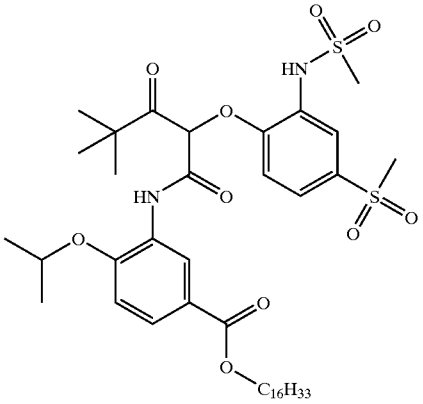
YC20
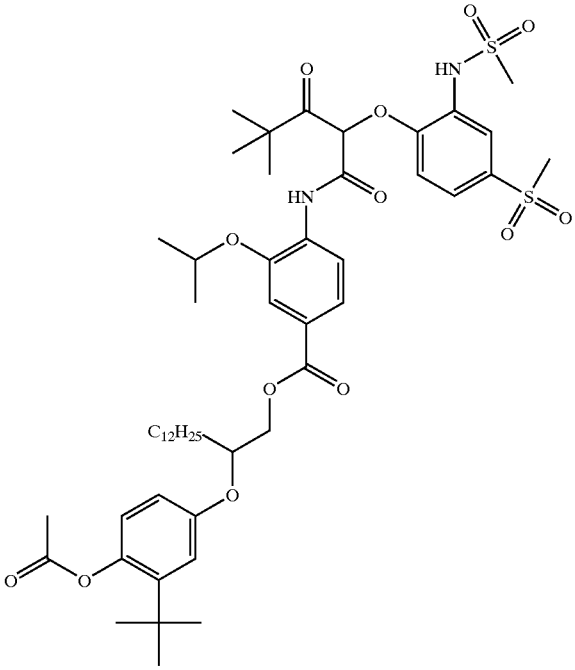
YC21
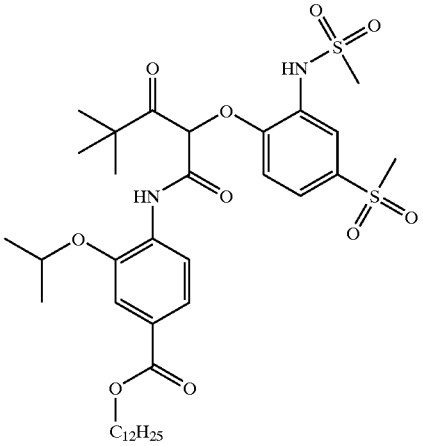
MC1
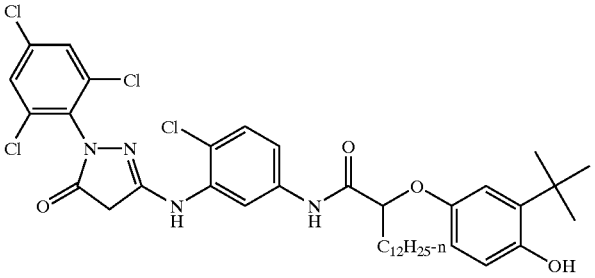

-continued
MC2
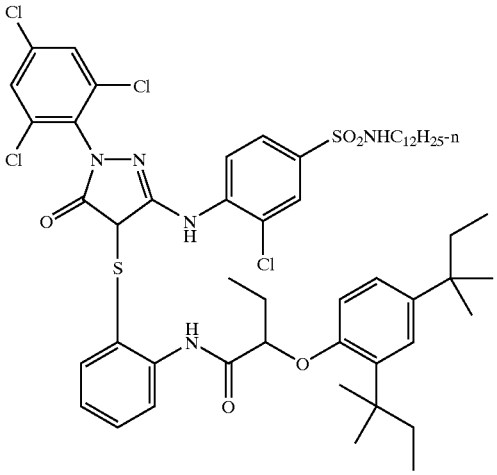
MC3
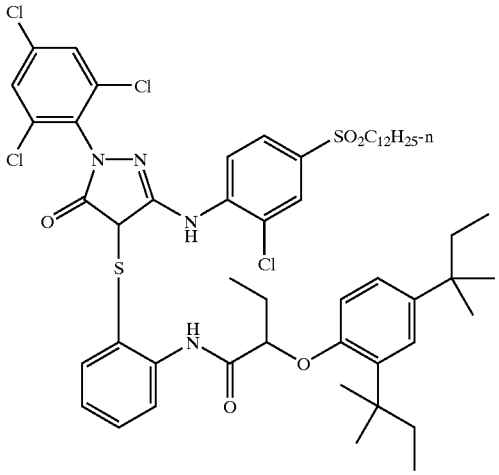
MC4
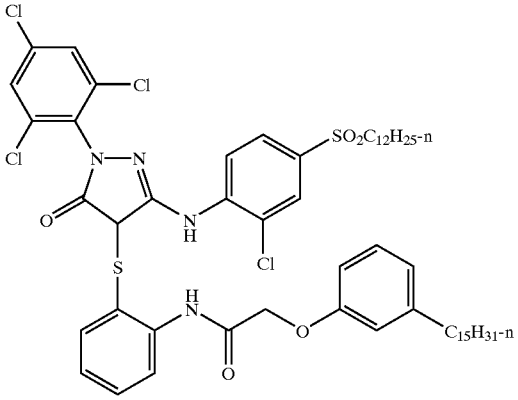
MC5
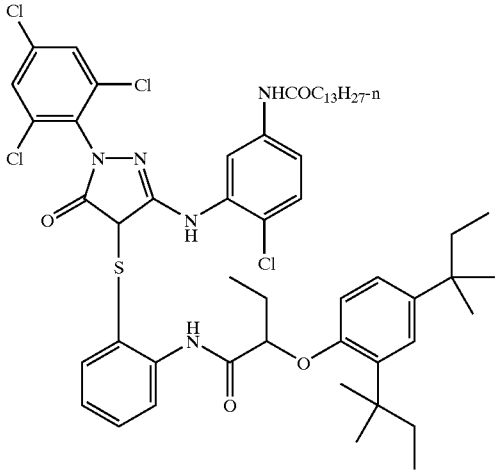
MC6
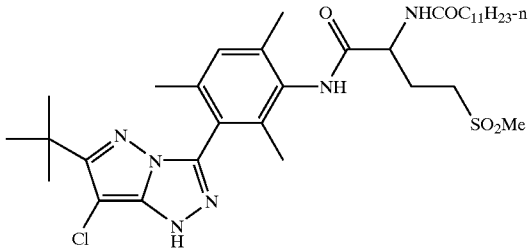
MC7
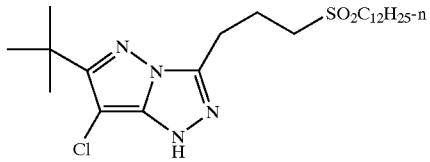
MC8
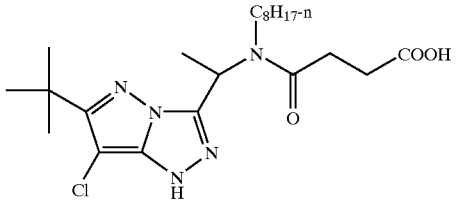

-continued
MC9
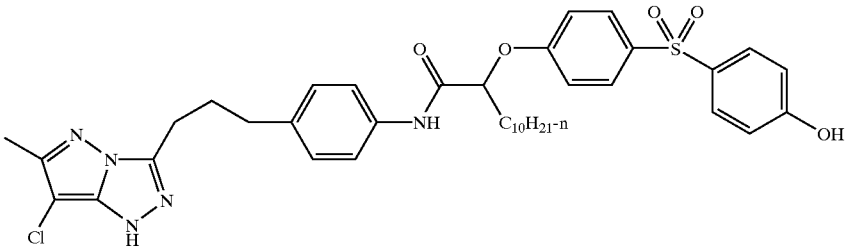
MC10
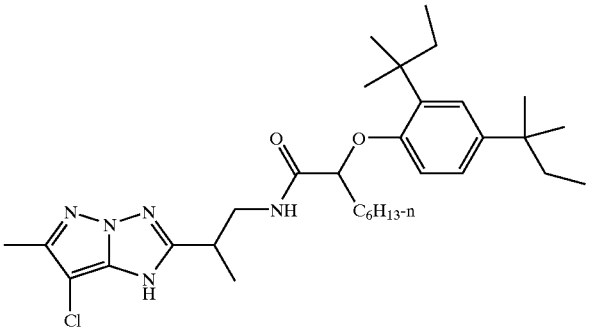
MC11
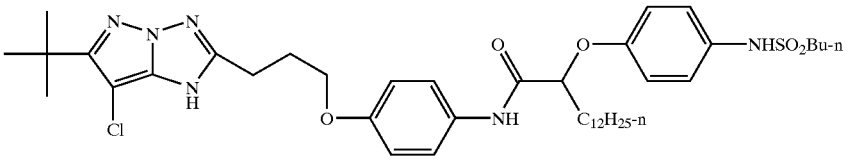
MC12
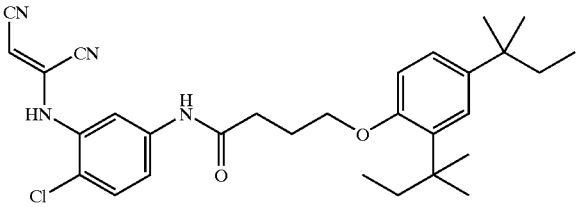
MC13
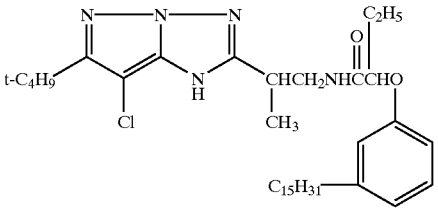
MC14
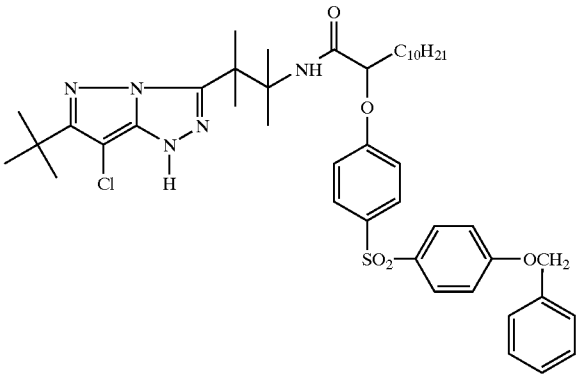
MC15
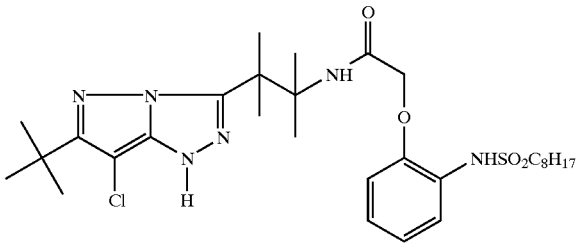

-continued
MC16
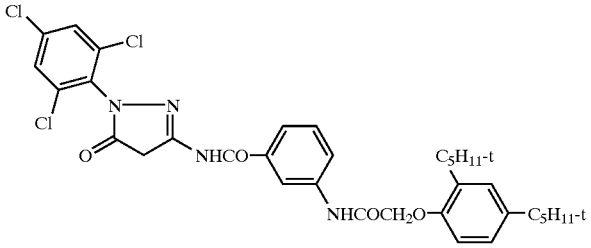
MC17
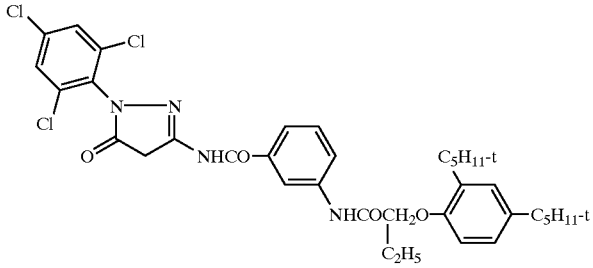
CC1
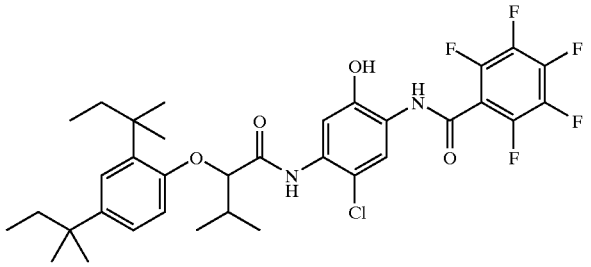
CC2
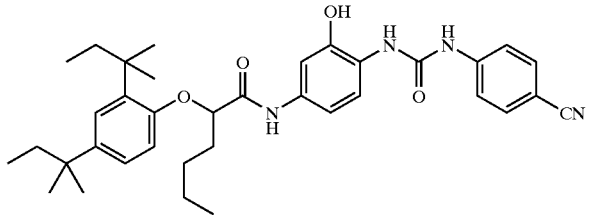
CC3
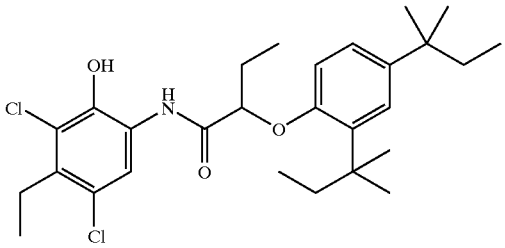
CC4
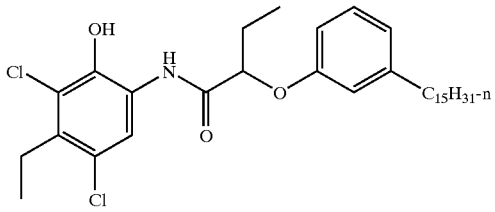
CC5
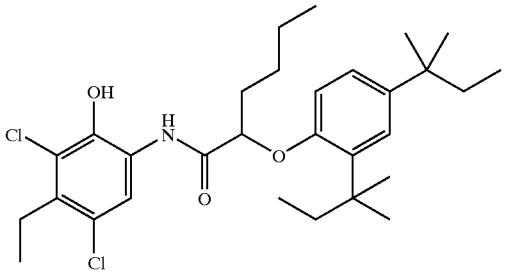
CC6
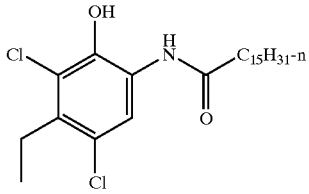
CC7
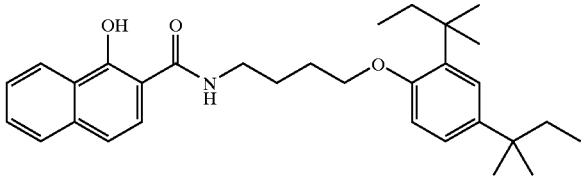
CC8
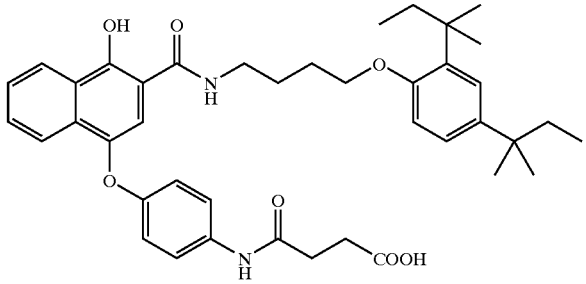

-continued
CC9
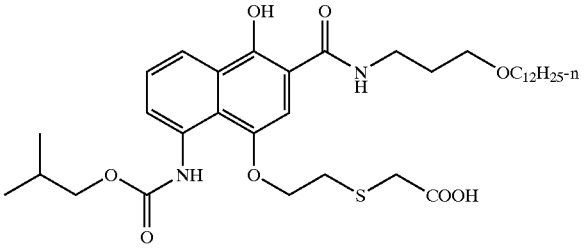
CC10
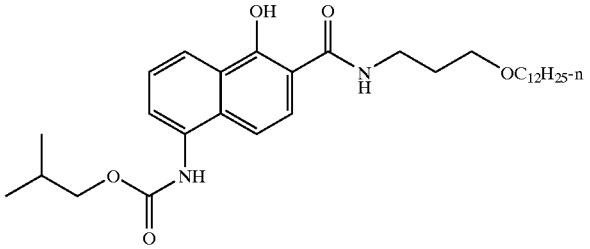
CC11
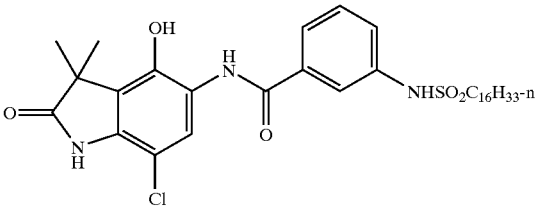
CC12
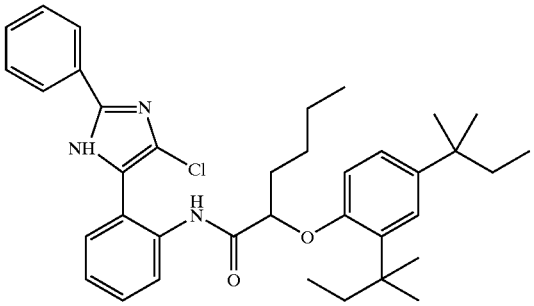
CC13
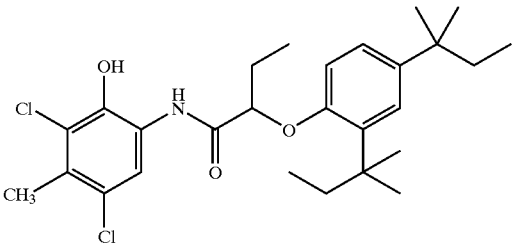
CC14
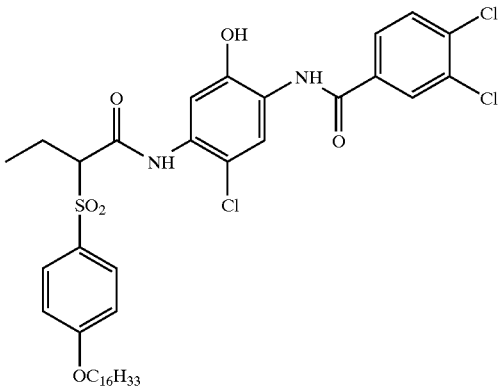
CC15
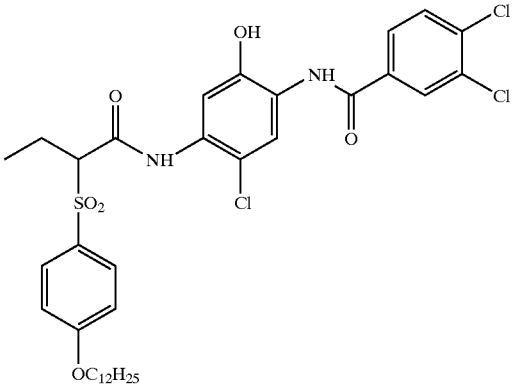
CC16
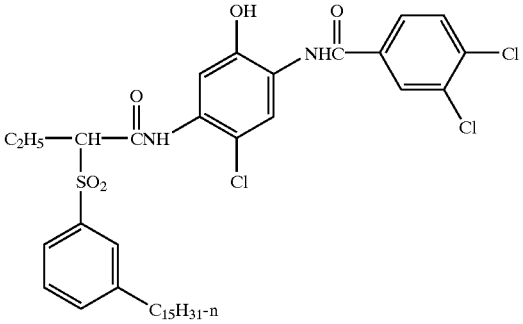

-continued

C17

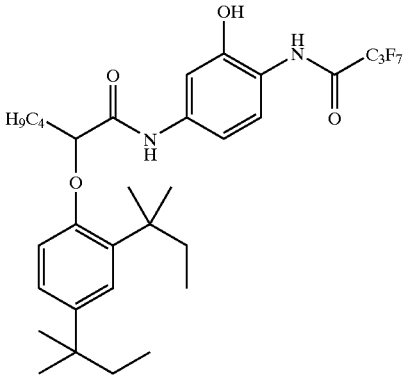

Typically, couplers and the stabilizers with which they are associated are dispersed in the same layer of the photographic element in a permanent high boiling organic compound known in the art as a coupler solvent, either alone or with auxiliary low boiling or water miscible solvents which are removed after dispersion formation. Permanent high boiling solvents have a boiling point sufficiently high, generally above 150° C. at atmospheric pressure, such that they are not evaporated under normal dispersion making and photographic layer coating procedures. Alternatively, the couplers and stabilizers may be dispersed without permanent high boiling solvents using only auxiliary solvent or precipitation techniques as is known in the art. The compounds may be co-dispersed, or may be dispersed separately and then combined. Representative conventional coupler solvents include phthalic acid alkyl esters such as diundecyl phthalate, dibutyl phthalate, bis-2-ethylhexyl phthalate, and dioctyl phthalate, phosphoric acid esters such as tricresyl phosphate, diphenyl phosphate, tris-2-ethylhexyl phosphate, and tris-3,5,5-trimethylhexyl phosphate, citric acid esters such as tributyl acetylcitrate, tributylcitrate and trihexylcitrate, 2-(2-Butoxyethoxy)ethyl acetate, and 1,4-Cyclohexyldimethylene bis(2-ethylhexanoate), benzoic acid esters such as octyl benzoate, aliphatic amides such as N,N-diethyl lauramide, N,N-Diethyldodecanamide, N,N-Dibutyldodecanamide, mono and polyvalent alcohols such as oleyl alcohol and glycerin monooleate, and alkyl phenols such as p-dodecyl phenol and 2,4-di-t-butyl or 2,4-di-t-pentyl phenol. Commonly used coupler solvents are the phthalate esters, which can be used alone or in combination with one another or with other coupler solvents. Selection of the particular coupler solvent has been found to have an influence on the activity of the coupler as well as the hue and stability of the dye formed on coupling. In accordance with certain embodiments, the compounds of Formula I may be advantageously used to partly or totally replace conventional high boiling solvents in dispersing the dye-forming couplers in the photographic elements of the invention.

Typically the amount of compound I used will range from about 0.05 to about 4.0 moles per mole of coupler, preferably from about 0.1 to 2.5 moles per mole of coupler. The coupler is typically coated in the element at a coverage of from 0.25 mmol/$m^2$ to 2.0 mmol/$m^2$, and preferably at a coverage of from 0.40 to 1.2 mmol/$m^2$. When a conventional permanent coupler solvent is employed, it typically is present in an amount of 0.1 to 5.0 mg/mg coupler, and preferably in an amount of 0.25 to 2.0 mg/mg coupler.

To further enhance the stability of the dyes formed in photographic elements in accordance with the invention, additional conventional stabilizing compounds may also be included. In accordance with a particularly preferred embodiment, the use of compounds of Formula I in combination with conventional substituted phenolic yellow dye stabilizers, and in particular substituted bisphenol based stabilizers, have been found to unexpectedly provide beneficial yellow formed dye light stability.

Substituted bisphenol light stabilizer compounds which may be used in accordance with preferred embodiments of the invention generally comprise bisphenol derivatives having two linked phenol rings wherein at least one of the phenol rings is substituted as described in the references cited above. Preferably, at least one of the phenolic hydroxy groups is also substituted with a blocking group. Such preferred blocked bisphenolic compounds are preferably of the following Formula II:

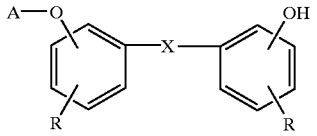

wherein A represents an alkyl (e.g., methyl, ethyl, propyl or butyl), cycloalkyl (e.g., cyclohexyl), alkenyl, aryl (e.g., phenyl), acyl (e.g., acetyl or benzoyl), alkylsulfonyl or arylsulfonyl substituent group, X represents a single bond or a bivalent linking group (e.g., an alkylidene group such as methyline, butylidine, or 3,3,5-trimethylhexylidene, or a heteroatom such as oxygen, sulfur, selenium, or tellurium, or a sulfonyl or phosphinyl group), and each R independently represents one or more alkyl, alkenyl, cycloalkyl, or aryl substituent group, such as described for A above, or in combination with the benzene ring to which it is attached represents the atoms necessary to complete a fused ring system. Each A, X and R substituent or linking group may be further substituted or unsubstituted. Specific examples of such blocked bisphenolic compounds, along with synthesis techniques, are disclosed, e.g., in U.S. Pat. Nos. 4,782,011 and 5,426,021, the disclosures of which are incorporated herein by reference. Additional substituted phenolic stabilizers which may be advantageously used in combination with the invention include those described in U.S. Pat. Nos. 5,091,294, 5,284,742, 5,935,773 and EP 0 310 551 and EP 0 310 552. When used in combination with compounds of the Formula I, the substituted phenolic stabilizers may be used at similar concentrations. Preferably, the molar ratio of compound of Formula I to substituted phenolic light stabilizer compound is from 1:12 to 25:1. The compounds of Formula I may also be used in combination with thiomorpholine compounds as described in EP 1 116 997. While it is an advantage of the invention that improved light stability may obviate the need for polymeric latex materials as light stabilizers, they may also be incorporated if desired. Specifically, the polymer latex materials as described in U.S. Pat. No. 5,981,159 may be employed.

To obtain a satisfactory color and tonal balance as photographic images fade on exposure to light, it is important to achieve a balanced rate of density loss from yellow, magenta and cyan dyes. It is particularly desirable to produce a balanced rate of yellow and magenta dye loss in order to maintain a pleasing reproduction of skin tones. In accordance with preferred embodiments of the invention, a balanced rate of fade can be achieved using a yellow dye-forming layer comprising a stabilizer combination in accordance with preferred embodiments of this invention in combination with a magenta dye-forming coupler layer comprising highly-stable pyrazolotriazole coupler.

The yellow, cyan and magenta dye forming couplers that may be used in the elements of the invention can be defined as being 4-equivalent or 2-equivalent depending on the number of atoms of $Ag^+$ required to form one molecule of dye. A 4-equivalent coupler can generally be converted into a 2-equivalent coupler by replacing a hydrogen at the coupling site with a different coupling-off group. Coupling-off groups are well known in the art. Such groups can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212 and 4,134,766; and in U.K. Patents and published Application Nos. 1,466,728; 1,531,927; 1,533,039; 2,006,755A and 2,017,704A, the disclosures of which are incorporated herein by reference.

To control the migration of various components coated in a photographic layer, including couplers, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to polymeric backbone.

Photographic elements of this invention can have the structures and components described in an article titled "Typical and Preferred Color Paper, Color Negative, and Color Reversal Photographic Elements and Processing," published in *Research Disclosure*, February 1995, Item 37038, pages 79–114. *Research Disclosure* is published by Kenneth Mason Publications, Ltd., Dudley Annex, 12a North Street, Emsworth, Hampshire P010 7DQ, ENGLAND. A typical multicolor photographic element of this invention comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective. In a preferred embodiment, the invention is directed towards a photographic element that may be displayed for extended periods under illuminated conditions, such as a color paper photographic element which comprises photographic layers coated on a reflective support. Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523.

While the order of the color sensitive layers in a photographic element in accordance with various embodiments of the invention can be varied, they will normally be red-sensitive, green-sensitive and blue-sensitive, in that order on a transparent support, (that is, blue sensitive furthest from the support) and the reverse order on a reflective support being typical. The element typically will have a total thickness (excluding the support) of from 5 to 30 microns.

This invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September 1994, Number 365, Item 36544, which will be identified hereafter by the term "Research Disclosure I" The Sections hereafter referred to are Sections of the *Research Disclosure I.*

The silver halide emulsions employed in the elements of this invention can be either negative-working, such as surface-sensitive emulsions or unfogged internal latent image forming emulsions, or direct positive emulsions of the unfogged, internal latent image forming type which are positive working when development is conducted with uniform light exposure or in the presence of a nucleating agent. Suitable emulsions and their preparation as well as methods of chemical and spectral sensitization are described in Sections I through V. Color materials and development modifiers are described in Sections V through XX. Vehicles which can be used in the elements of the present invention are described in Section II, and various additives such as brighteners, antifoggants, stabilizers, light absorbing and scattering materials, hardeners, coating aids, plasticizers, lubricants and matting agents are described, for example, in Sections VI through X and XI through XIV. Manufacturing methods are described in all of the sections, other layers and supports in Sections XI and XIV, processing methods and agents in Sections XIX and XX, and exposure alternatives in Section XVI.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117; U.K. Patent 1,530,272; Japanese Application A-1 13935; U.S. Pat. No. 4,070,191 and German Application DE 2,643, 965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol, ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019, 492.

The photographic elements may further contain other image-modifying compounds such as developer inhibitor releasing compounds (DIR's).

The elements of the present invention may be employed to obtain reflection color prints as described in *Research Disclosure*, November 1979, Item 18716, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165, U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Patent Applications 83/09,959; 83/62,586; 90/072,629, 90/072,630; 90/072,632; 90/072,633; 90/072,634; 90/077,822; 90/078, 229; 90/078,230; 90/079,336; 90/079,338; 90/079,690; 90/079,691; 90/080,487; 90/080,489; 90/080,490; 90/080, 491; 90/080,492; 90/080,494; 90/085,928; 90/086,669; 90/086,670; 90/087,361; 90/087,362; 90/087,363; 90/087, 364; 90/088,096; 90/088,097; 90/093,662; 90/093,663; 90/093,664; 90/093,665; 90/093,666; 90/093,668; 90/094, 055; 90/094,056; 90/101,937; 90/103,409; 90/151,577.

The silver halide emulsion grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 80° C., as illustrated in *Research Disclosure*, June 1975, item 13452 and U.S. Pat. No. 3,772,031.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, The *Theory of the Photographic Process*, 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog unexposed silver halide (usually chemical or light fogging), followed by treatment with a color developer. Preferred color developing agents are p-phenylenediamines. Especially preferred are: 4-amino-N,N-diethylaniline hydrochloride, 4-amino-3-methyl-N,N-diethylaniline hydrochloride, 4-amino-3-methyl-N-ethyl-N-(b-(methanesulfonamido) ethylaniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying. Bleaching and fixing can be performed with any of the materials known to be used for that purpose. Bleach baths generally comprise an aqueous solution of an oxidizing agent such as water soluble salts and complexes of iron (III)(e.g., potassium ferricyanide, ferric chloride, ammonium or potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

The photographic elements comprising stabilizers in accordance with this invention may be processed in amplification processes that use developer/amplifier solutions described in U.S. Pat. No. 5,324,624, for example. When processed in this way, the low volume, thin tank processing system and apparatus described in U.S. Pat. No. 5,436,118 preferably is employed.

EXAMPLES

The following examples further illustrate this invention. In such examples, couplers of the above structures YC-2, YC-19, YC-20 and YC-21 are employed. Also, in addition to various compounds of Formula I above, stabilizers YSt-1 through YSt-3 are employed:

YSt-1

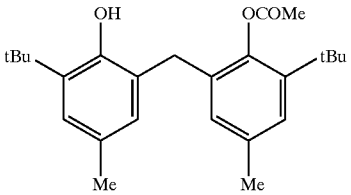

-continued

YSt-2

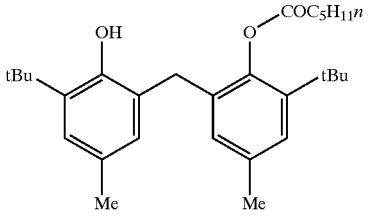

YSt-3

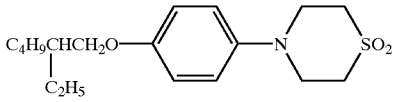

Comparison coupler solvents used in the examples are the following:

CS-1

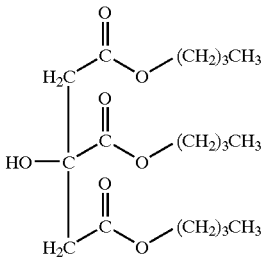

CS-2

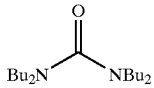

CS-3

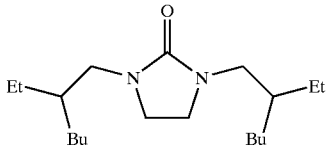

CS-4

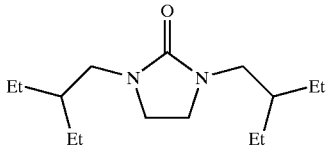

either CS-1 or compound Ia with heating, and dispersing the oil phase in an aqueous phase containing gelatin and surfactant Alkanol-XC by homogenizing the mixture in a colloid mill. Each of the coupler dispersions was mixed with a blue-sensitive cubic silver chloride photographic emulsion for coating on a resin-coated paper support, pre-coated with an unhardened gel pad. The coating structure is shown below.

| Coating Structure | |
|---|---|
| GEL SUPERCOAT | |
| Gelatin | 14 $g.m^{-2}$ |
| Hardener* | 0.15 $g.m^{-2}$ |
| Coating Surfactants | |

-continued

| Coating Structure | |
|---|---|
| PHOTOSENSITIVE LAYER | |
| Gelatin | 2.15 $g.m^{-2}$ |
| Coupler | $5.93 \times 10^{-4}$ $mol/m^2$ |
| Coupler solvent | equal to weight of coupler |
| Ag Halide emulsion | 0.210 $g.m^{-2}$ (as Ag) |
| GEL PAD | |
| Gelatin | 3.230 $g.m^{-2}$ |
| Resin Coated Paper | |

Hardener = bis(vinylsulphonylmethane)

Sample strips of the coatings were exposed to blue light through a step tablet (density range 0–3, 0.15 increments) and developed in standard Kodak RA4 processing solutions before washing and drying. Sensitometric curves were generated for each processed strip. The maximum density achieved, Dmax, is reported for each coating. Higher Dmax values correspond to greater reactivity. RA4 processing solutions before washing and drying. Sensitometric curves were generated for each processed strip. The maximum density achieved, Dmax, is reported for each coating. Higher Dmax values correspond to greater reactivity. The image dye light stability was assessed using simulated daylight fading equipment incorporating a rotating Xenon arc light source surrounded by window glass, delivering an exposure intensity of 50 Klux at the sample plane. Prior to fade testing, the samples were covered with a clear acetate film with UV-absorbing dye coating. At the end of these tests, the densities of the sample strips were re-measured and compared with the initial curves. Status "A" blue density changes from an initial density value of 1.0 after 3 weeks treatment are recorded in the Table 1 below. The change in Status A blue Dmin (minimum density) was also recorded.

TABLE 1

| | | | | Light stability: 50 klux for 3 weeks | |
|---|---|---|---|---|---|
| Sample | Coupler | Solvent Compnd | Dmax | ΔD @ D = 1.0 | ΔDmin |
| 1.1 (Comp) | YC2 | CS-1 | 2.19 | −.86 | −0.07 |
| 1.2 (Inv) | YC2 | Ia | 2.48 | −.23 | −0.08 |
| 1.3 (Comp) | YC19 | CS-1 | 2.00 | −.61 | −0.05 |
| 1.4 (Inv) | YC19 | Ia | 2.34 | −.06 | −0.02 |

Use of compound Ia in accordance with the invention showed greatly improved light stability. Additional tests also demonstrated that such compounds provided good dark stability. Additionally, use of compounds of the invention also provide coatings with higher Dmax.

Example 2

Coatings were made, processed, and evaluated similarly as described for Example 1, except that the stabilizers YSt-1, Yst-2, and Yst-3 were added to the yellow coupler dispersions at coverages of 53.8, 8.6, and 53.8 $mg/m^2$, respectively, using various combinations of couplers and solvents as indicated in Table 2.

TABLE 2

| | | | | Light stability: 50 klux for 3 weeks | |
|---|---|---|---|---|---|
| Sample | Coupler | Solvent Compnd | Dmax | ΔD @ D = 1.0 | ΔDmin |
| 2.1 (Comp) | YC2 | CS-1 | 2.36 | −.53 | −0.02 |
| 2.2 (Inv) | YC2 | Ia | 2.45 | −.12 | −0.03 |
| 2.3 (Comp) | YC19 | CS-1 | 2.23 | −.33 | 0.00 |
| 2.4 (Inv) | YC19 | Ia | 2.35 | −.05 | −0.01 |
| 2.5 (Comp) | YC20 | CS-1 | 2.40 | −.24 | 0.01 |
| 2.6 (Inv) | YC20 | Ia | 2.52 | −.08 | −0.01 |
| 2.7 (Comp) | YC21 | CS-1 | 2.37 | −.50 | 0.00 |
| 2.8 (Inv) | YC21 | Ia | 2.50 | −.10 | −0.02 |

As in Example 1, use of compound Ia in accordance with the invention showed improved light stability with a variety of yellow image dye-forming couplers in combination with yellow dye stabilizing compounds. Additional tests also demonstrated that such compound provided good dark stability. Additionally, use of compounds of the invention also provide coatings with higher Dmax.

Example 3

Additional coatings were made, processed, and evaluated similarly as described for example 2, using various combinations of couplers and solvents as indicated in Table 3.

TABLE 3

| Sample | Coupler | Solvent Compnd | Dmax | ΔD @ D = 1.0 |
|---|---|---|---|---|
| 3.1 (Inv) | YC2 | Ia | 2.44 | −0.11 |
| 3.2 (Inv) | " | Ib | 2.39 | −0.10 |
| 3.3 (Inv) | " | Ic | 2.33 | −0.14 |
| 3.4 (Inv) | " | Id | 2.33 | −0.08 |
| 3.5 (Inv) | " | Ig | 2.38 | −0.10 |
| 3.6 (Inv) | " | If | 2.38 | −0.10 |
| 3.7 (Inv) | " | Ix | 2.31 | −0.08 |
| 3.8 (Inv) | " | It | 2.34 | −0.10 |
| 3.9 (Inv) | " | Iu | 2.30 | −0.11 |
| 3.10 (Inv) | " | Iv | 2.30 | −0.12 |
| 3.11 (Inv) | " | Iw | 2.08 | −0.20 |
| 3.12 (Inv) | " | Iz | 2.32 | −0.11 |
| 3.13 (Inv) | " | Ij | 2.32 | −0.11 |
| 3.14 (Comp) | " | CS-1 | 2.25 | −0.47 |
| 3.15 (Comp) | " | CS-1 | 2.33 | −0.51 |
| 3.16 (Comp) | " | CS-2 | 2.42 | −0.49 |
| 3.17 (Comp) | " | CS-3 | 2.29 | −0.58 |
| 3.18 (Comp) | " | CS-4 | 2.32 | −0.51 |
| 3.19 (Inv) | YC19 | Ia | 2.33 | −0.04 |
| 3.20 (Inv) | " | Ib | 2.28 | −0.02 |
| 3.21 (Inv) | " | Ic | 2.19 | −0.06 |
| 3.22 (Inv) | " | Id | 2.25 | −0.03 |
| 3.23 (Inv) | " | Ig | 2.25 | −0.05 |
| 3.24 (Inv) | " | If | 2.27 | −0.03 |
| 3.25 (Inv) | " | Ix | 2.20 | −0.03 |
| 3.26 (Inv) | " | It | 2.17 | −0.04 |
| 3.27 (Inv) | " | Iu | 2.15 | −0.05 |
| 3.28 (Inv) | " | Iv | 2.18 | −0.06 |
| 3.29 (Inv) | " | Iw | 2.26 | −0.06 |
| 3.30 (Inv) | " | Iz | 2.19 | −0.05 |
| 3.31 (Inv) | " | Ij | 2.22 | −0.05 |
| 3.32 (Comp) | " | CS-1 | 2.09 | −0.29 |
| 3.33 (Comp) | " | CS-1 | 2.19 | −0.28 |
| 3.34 (Comp) | " | CS-2 | 2.21 | −0.27 |
| 3.35 (Comp) | " | CS-3 | 2.23 | −0.24 |
| 3.36 (Comp) | " | CS-4 | 2.07 | −0.22 |

As in Examples 1 and 2, use of compounds of Formula I in accordance with the invention showed greatly improved light stability with a variety of yellow image dye-forming couplers relative to comparison solvents. Additional tests also demonstrated that such compounds provided good dark stability.

Example 4

Coatings were made, processed, and evaluated similarly as described for Example 2, using various combinations of couplers and solvents as indicated in Table 4.

TABLE 4

| Sample | Coupler | Solvent Compnd | Dmax | Light stability: 50 klux for 3 weeks ΔD @ D = 1.0 | ΔDmin |
|---|---|---|---|---|---|
| 4.1 (Comp) | YC2 | CS-1 | 2.28 | −.47 | −0.02 |
| 4.2 (Inv) | " | Iae | 2.35 | −.07 | −0.02 |
| 4.3 (Inv) | " | Iaf | 2.42 | −.05 | −0.02 |
| 4.4 (Inv) | " | Iag | 2.37 | −.12 | −0.02 |
| 4.5 (Comp) | YC19 | CS-1 | 2.18 | −.27 | 0.00 |
| 4.6 (Inv) | " | Iae | 2.29 | −.03 | 0.00 |
| 4.7 (Inv) | " | Iaf | 2.30 | −.01 | 0.00 |
| 4.8 (Inv) | " | Iag | 2.31 | −.04 | 0.00 |

Use of compounds in accordance with the invention showed greatly improved light stability. Additionally, use of compounds of the invention also provide coatings with higher Dmax.

Example 5

Coatings were made, processed, and evaluated similarly as described for Example 2, using various combinations of couplers and solvents as indicated in Table 5.

TABLE 5

| Sample | Coupler | Solvent Compnd | Dmax | Light stability: 50 klux for 3 weeks ΔD @ D = 1.0 | ΔDmin |
|---|---|---|---|---|---|
| 5.1 (Comp) | YC2 | CS-1 | 2.35 | −.43 | −0.03 |
| 5.2 (Inv) | " | Iab | 2.01 | −.16 | −0.06 |
| 5.3 (Inv) | " | Iac | 2.36 | −.09 | −0.03 |
| 5.4 (Inv) | " | Iad | 1.75 | −.09 | −0.03 |
| 5.5 (Inv) | " | Iaa | 2.37 | −.09 | −0.03 |
| 5.6 (Comp) | YC19 | CS-1 | 2.19 | −.26 | −0.01 |
| 5.7 (Inv) | " | Iab | 1.96 | −.10 | −0.04 |
| 5.8 (Inv) | " | Iac | 2.27 | −.04 | −0.01 |
| 5.9 (Inv) | " | Iad | 2.25 | −.04 | −0.01 |
| 5.10 (Inv) | " | Iaa | 2.30 | −.03 | −0.01 |

Use of compounds in accordance with the invention again showed greatly improved light stability.

The invention has been described by reference to preferred embodiments, but it will be understood changes can be made to the embodiments specifically described herein within the spirit and scope of the invention.

What is claimed is:

1. A photographic element comprising a silver halide emulsion layer having associated therewith a dye forming coupler and a compound of the following Formula I:

I

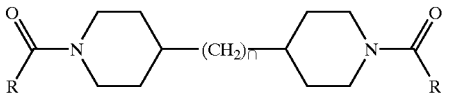

wherein n represents an integer of from 0–6 and each R is independently hydrogen, an aromatic, cyclic, linear or branched chain hydrocarbon group, NR'R", or OR', where R' is an aromatic, cyclic, linear or branched chain hydrocarbon group and R" is hydrogen or an aromatic, cyclic, linear or branched chain hydrocarbon group.

2. An element according to claim 1, wherein each R is independently hydrogen or an aromatic, cyclic, linear or branched chain hydrocarbon group of from 1 to 22 carbon atoms.

3. An element according to claim 1, wherein each R is NR'R", where R' is an aromatic, cyclic, linear or branched chain hydrocarbon group of from 1 to 22 carbon atoms and R" is hydrogen or an aromatic, cyclic, linear or branched chain hydrocarbon group of from 1 to 22 carbon atoms.

4. An element according to claim 1, wherein each R is OR'; where R' is an aromatic, cyclic, linear or branched chain hydrocarbon group of from 1 to 22 carbon atoms.

5. An element according to claim 1, wherein the dye-forming coupler comprises an acetanilide-based yellow dye-forming coupler.

6. An element according to claim 5, wherein each R is independently hydrogen or an aromatic, cyclic, linear or branched chain hydrocarbon group of from 1 to 22 carbon atoms.

7. An element according to claim 5, wherein each R is NR'R", where R' is an aromatic, cyclic, linear or branched chain hydrocarbon group of from 1 to 22 carbon atoms and R" is hydrogen or an aromatic, cyclic, linear or branched chain hydrocarbon group of from 1 to 22 carbon atoms.

8. An element according to claim 5, wherein each R is OR'; where R' is an aromatic, cyclic, linear or branched chain hydrocarbon group of from 1 to 22 carbon atoms.

9. An element according to claim 5, wherein the silver halide emulsion layer further has associated therewith a substituted phenolic light stabilizer compound.

10. An element according to claim 9, wherein the molar ratio of compound of Formula I to substituted phenolic light stabilizer compound is from 1:12 to 25:1.

11. An element according to claim 9, wherein the substituted phenolic light stabilizer compound is a substituted bisphenolic light stabilizer compound.

12. An element according to claim 11 wherein the substituted bisphenol compound is of the formula:

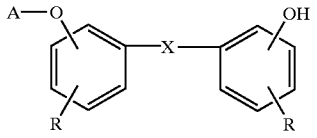

wherein A represents an alkyl, cycloalkyl, alkenyl, aryl, acyl, alkylsulfonyl or arylsulfonyl group, X represents a single bond or a bivalent linking group, and each R independently represents one or more alkyl, alkenyl, cycloalkyl, or aryl group, or in combination with the benzene ring to which it is attached represents the atoms necessary to complete a fused ring system.

13. An element according to claim 5, wherein the yellow coupler of the formula

YELLOW-1

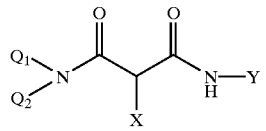

YELLOW-2

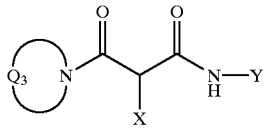

YELLOW-3

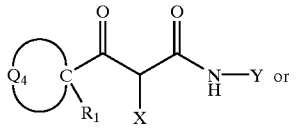

YELLOW-4

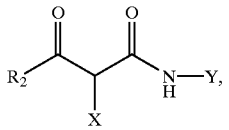

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and $Q_4$ represents nonmetallic atoms necessary to form a 3- to 5-membered hydrocarbon ring or a 3- to 5-membered heterocyclic ring which contains at least one hetero atom selected from N, O, S, and P in the ring.

14. An element according to claim 13, wherein the yellow coupler is of the formula YELLOW-4 where $R_2$ represents an aryl or alkyl group and Y represents an aryl group.

15. An element according to claim 14, wherein $R_2$ represents a tertiary alkyl group.

16. An element according to claim 5, wherein the molar ratio of compound of formula I to yellow coupler is from 0.05:1 to 4.0:1.

17. An element according to claim 5, wherein the molar ratio of compound of formula I to yellow coupler is from 0.1:1 to 2.5:1.

18. An element according to claim 5, comprising a color paper photographic element which comprises a reflective support.

19. An element according to claim 1, comprising a color paper photographic element which comprises a reflective support.

20. An element according to claim 1, wherein the molar ratio of compound of formula I to coupler is from 0.05:1 to 4.0: 1.

21. An element according to claim 1, wherein the molar ratio of compound of formula I to coupler is from 0.1:1 to 2.5:1.

* * * * *